United States Patent [19]

Damen

[11] Patent Number: 4,848,419

[45] Date of Patent: Jul. 18, 1989

[54] DEVICE FOR EVACUATING OXYGEN FROM A CONTAINER

[75] Inventor: Franciscus A. Damen, Langeweg, Netherlands

[73] Assignee: Calumatic B. V., AC Dongen, Netherlands

[21] Appl. No.: 130,419

[22] Filed: Dec. 9, 1987

[30] Foreign Application Priority Data

Dec. 12, 1986 [NL] Netherlands ..... 8603176

[51] Int. Cl.[4] ..... B65B 3/04

[52] U.S. Cl. ..... 141/61; 141/5; 141/59; 141/66; 141/103; 53/109; 53/381 A; 53/510

[58] Field of Search ..... 53/109, 381 A, 510, 53/405, 408, 468, 432; 141/4, 6, 8, 7, 9, 5, 82, 59, 61, 52, 65, 66, 129, 165, 144, 181, 372, 103

[56] References Cited

U.S. PATENT DOCUMENTS

| | | | |
|---|---|---|---|
| 1,591,932 | 7/1926 | Young | 141/8 |
| 3,350,839 | 11/1967 | Carter | 53/510 X |
| 3,951,186 | 4/1976 | Mencacci | 141/5 |
| 4,186,542 | 2/1980 | Oyagi | 53/109 X |
| 4,407,340 | 10/1983 | Jensen et al. | 141/82 X |
| 4,489,767 | 12/1984 | Yamada | 141/82 X |
| 4,655,029 | 4/1987 | Weiss | 53/432 |
| 4,662,154 | 5/1987 | Hayward | 141/100 X |

FOREIGN PATENT DOCUMENTS

| | | | |
|---|---|---|---|
| 2104100 | 4/1972 | France . | |
| 910584 | 11/1962 | United Kingdom . | |
| 2163414 | 2/1986 | United Kingdom | 141/4 |

*Primary Examiner*—Ernest G. Cusick

*Attorney, Agent, or Firm*—Dressler, Goldsmith, Shore, Sutker & Milnamow, Ltd.

[57] ABSTRACT

A device for reducing the quantity of oxygen in the space above the filling in a container before closing of the container, in which a vacuum is formed in the space, then a compressed gas is blown into the container in a direction running obliquely to the vertical axis of symmetry of the container and again a vacuum is formed in the space, these steps being repeated if necessary. Valving is provided in the fixed housing within which are formed, coaxially with a central column, an inner chamber and an outer, essentially cylindrical chamber enclosing it. One chamber is connected to a vacuum source and the other chamber to a source of the gas. One head face of each chamber has a plurality of openings at specific angular distances from each other and disposed on an inner and an outer circle respectively. Fixed on the central column is a disc in sealing fashion against the head faces. Two series of openings with equal angular distances from each other are formed on an inner and outer circle, respectively, the radii of these inner and outer circles being virtually equal to those of the first-mentioned inner and outer circle.

5 Claims, 3 Drawing Sheets

DEVICE FOR EVACUATING OXYGEN FROM A CONTAINER

TECHNICAL FIELD

The invention relates to a device for reducing the quantity of oxygen in the space above the filling in a container before closing of the container, in which a vacuum is formed in said space, then a compressed gas which is inert for the contents of the container is blown into the container and again a vacuum is formed in said space, these steps being repeated if necessary. The invention also relates to a device comprising a number of sealing heads mounted in the form of a carousel on a vertical central column which is rotatable, each of said heads being able to sealingly engage the top of a container provided with a filling opening, so that the filling opening comes to be situated in a space within the sealing head and sealed off from the ambient air. The said space is connectable with a source of vacuum and operable valve means for alternately putting into communication said space with a vacuum source and a source of a chemically inert gas.

BACKGROUND OF THE INVENTION

In the case of certain substances put on the market in sealed containers, in particular liquids for medical purposes, or food, it is a requirement that the quantity of oxygen in the space above the filling should not exceed a certain level, since too much oxygen is harmful to the substance packed in the container. This maximum permitted quantity of oxygen is many times smaller than the quantity of oxygen contained in the atmospheric air with which the said space is filled after filling of the container.

Hitherto, for reducing this amount of oxygen, as much air as possible was extracted from the said space above the filling, so that a vacuum was created there. However, too great a vacuum may not be created there, otherwise there is a risk of the liquid with which the container is filled starting to boil and being extracted with the air and/or of the container collapsing.

The amount of air going with maximum permitted vacuum does, however, still contain an inadmissibly large quantity of oxygen. In order to make this quantity of oxygen harmless, a so-called antioxidant is added to the filling. However, there are to an increasing extent prohibitions of this last-mentioned practice.

In the French patent specification No. 1426235 a process and device of the above-mentioned type is disclosed in which the filling opening of a container is inserted in a space which is sealed off from the outside air after which said space is placed in connection with a vacuum source by opening a first valve means so that a vacuum is created inside said space and said container and then, by opening a second valve means said first valve means being closed, said space is placed in connection with a source of a chemically inert gas so that said gas flows in random directions into said container and mixes therein with the air still present in the vacuum, whereupon again a vacuum is created in said space. The valve means are formed by two valves by means of which said space can be put into communication with either a source of an inert gas or with only one vacuum source, said valves comprising each a valve disc connected to a valve rod which disc operates with an annular valve seat. In addition a third valve of this type is provided by means of which said space can be put into communication with the outside air in order to be able to remove the container from said space after the container being closed.

It has been found that according to the known process the quantity of oxygen in the space above the filling in a container can be reduced only to slightly less than 2% which percentage is much too high for containers containing a pharmaceutical product. Moreover valves of the type used in the known device cannot be cleaned to that extent as required by the pharmaceutical industry.

In the British patent specification No. 910584 a device for the evacuation and sealing of containers is described in which a nozzle is inserted into the container and the sidewalls of the container are pressed against the nozzle to form a substantially air tight seal there between. The nozzle is connected through a conduit with a passageway bored in a ring which is adapted to rotate together with said nozzle, which passageway opens at a face of said ring which is in engagement with a face of a stationary plate in which a plurality of recesses are formed which during the rotational movement of the ring become aligned successively with the opening of said passageway, each recess in the stationary plate being into communication through said plate with a separate conduit which is connected with a source of an inert gas and a vacuum source respectively.

Thus in this control mechanism for each step of either forming a vacuum or feeding an inert gas there has to be a conduit extending from the relevant recess in the fixed plate to the relevant source so that it is practically impossible to have more than three recesses resulting in that only three steps can be executed, a vacuum step, a gas feeding step and again a vacuum step. Moreover the recess for the gas feeding step is located between the two recesses for the vacuum steps so that there is the risk that the vacuum source will be in direct communication with the vacuum source through the joint between the ring and the fixed plate.

The object of the invention is to provide an improved process and dvice by which the quantity of oxygen in the space above the filling of a container can be decreased to less than 0,5%.

This object is achieved in that in the process according to the invention, the compressed gas is blown into the container in a direction running obliquely to the vertical axis of symmetry of the container.

In this way, by blowing in the inert gas also a very large quantity of the air still present in the vacuum is expelled from the container and is replaced by the inert gas, thereby considerably reducing the quantity of oxygen, in particular when the inert gas, for example nitrogen, has a lower specific gravity than air, so that an improved expelling effect is obtained.

Preferably a final vacuum is created in the space as a last step, during which step the quantity of oxygen in the container is, of course, again reduced, the final vacuum being of a depth which differs from that of the previous vacuums.

SUMMARY OF THE INVENTION

In the device of the invention the nozzle which can be placed in connection with a source of a chemically inert gas opens in the space inside the sealing head in such a way that it is possible to produce a jet of the said gas flowing out of said nozzle and directed towards the filling opening of a container in a direction extending obliquely to the vertical axis of the container. The device further comprises a fixed, essentially enclosed housing within which are formed, coaxially with the central column, an inner chamber and an outer, essentially cylindrical chamber enclosing it, one of these chambers being connected to the vacuum source and the other chamber to the source of a chemically inert gas. Provision is made in one head face of each chamber for a number of openings at specific angular distances from each other and disposed on an inner and an outer circle respectively. Fixed on the central rotating column is a disc which rests in sealing fashion against said head faces, and in which two series of openings with equal angular distances from each other are formed on an inner and outer circle respectively. The radii of these inner and outer circles are virtually equal to those of the first-mentioned inner and outer circle and the openings of the inner series and the openings of the outer series are each individually connected to the said space in a sealing head and the nozzle opening therein respectively.

With a device designed in this way, a number of containers rotating in a circular track can be treated one after the other and, due to the fact that during rotation of the column the openings in the disk going with a sealing head always coincide at particular moments with the inner or outer openings in the head faces of the chambers, each container is subjected at the right moments to the successive steps of creation of a vacuum and blowing in of a chemically inert gas. At the same time, the connections between the respective sealing heads and the vacuum and gas sources respectively are separated from each other and there is no risk that said sources are short-circuited. Moreover the device according to the invention is extremely well adapted to be cleaned in accordance with the required c.i.p.-s.i.p. principle (clean in place, sterilize in place).

If it is desired that a final vacuum should be created in the containers with a depth which differs from that of the previous vacuums, then provision is made for a length of tubing which runs in the axial direction through the chamber connected to the vacuum source and which at the said head face of said chamber connects to an opening provided therein, and whose other end is passed through the opposite head face of said chamber and connected to a second vacuum source.

Preferably the openings in the said head faces of the chambers, at least the part facing the disc, are in the shape of a circular arc-shaped groove, whereby the times during which the containers are subjected to the various steps can be adapted to the particular volume of the space above the filling in the containers.

Advantageously the sealing heads are each provided with a suction head to be connected to a vacuum source for taking into the said space a closing cap or cover for the container. To prevent the cap from falling from the suction head, provision is made for a catch mechanism in each sealing head to retain the closing cap in a position that does not block the filling opening of a container before the final gas-inblowing step has been carried out.

BRIEF DESCRIPTION OF THE DRAWINGS

The invention is explained in greater detail with reference to the drawing, in which.

DETAILED DESCRIPTION OF THE INVENTION

Figure 1:
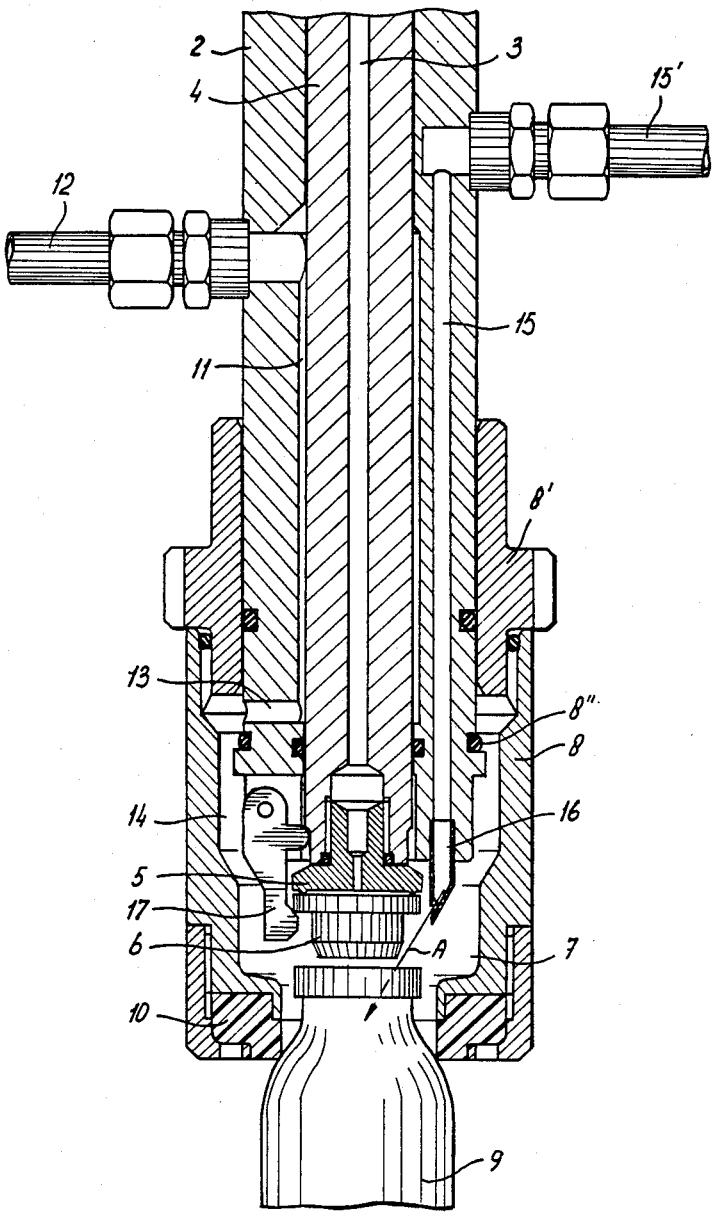
FIG. 1 shows in axial section a sealing head of a device according to the invention.
Figure 2:
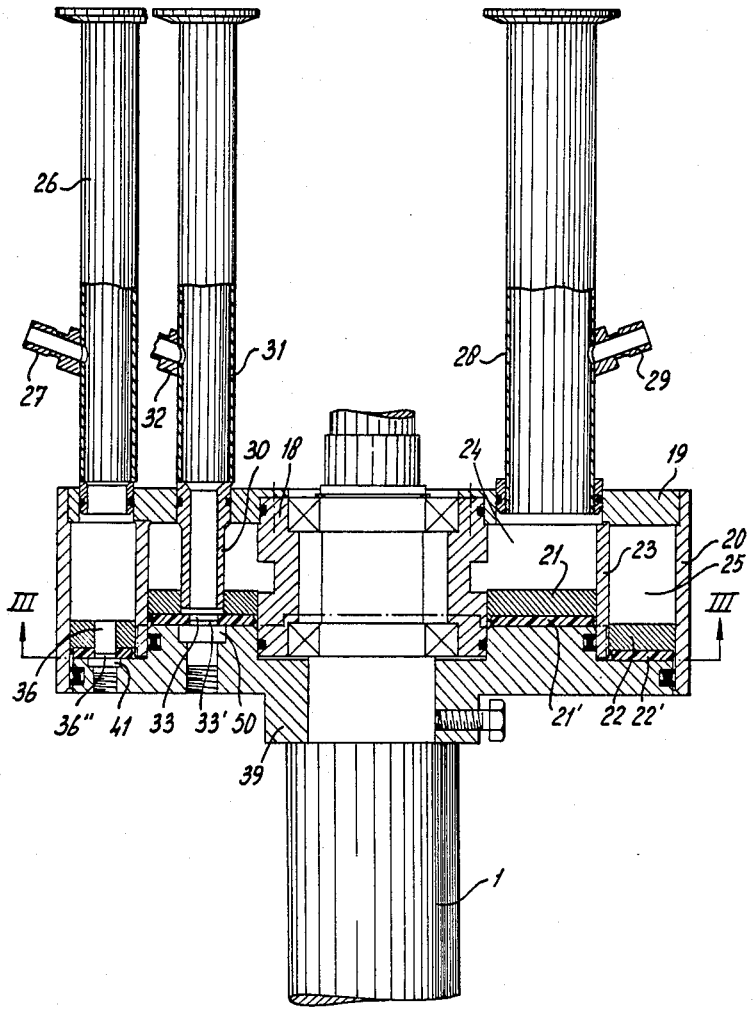
FIG. 2 shows an axial section the control device according to the invention.

The device comprises a number of sealing heads, one of which is shown in FIG. 1, and which are mounted, standing upright, at equal angular intervals in a circle, in a manner not illustrated in greater detail, on the vertical central column 1 (see FIG. 2).

Each sealing head has a relatively thick-walled length of tubing 2, which at the top end, for an up and down movement, is guided in a curved track (not shown), and within which a rod 4 provided with a central channel 3 can slide up and down. Disposed on the rod 4 at the bottom end is a suction head 5, so that by connecting the channel 3, in a manner not further illustrated, to a vacuum source, a closing cap 6 for a container can be sucked fast on the suction cap 5, while the rod 4 is in the bottom position not shown, and if the rod 4 is then raised to the position shown, this cap 6 can be retained inside the space 7 of the sealing head.

This space 7 is enclosed by a sealing sleeve 8 which is connected to a slide piece 8' which is under a downward-directed spring pressure (not shown), and which can slide along the tube 2, permitting the sealing sleeve 8 to move up and down between a bottom position which is not shown and the top position which is shown. In this top position the sealing sleeve encloses the top of the container 9, while the sealing ring 10 disposed at the end of the sealing sleeve engages in sealing fashion with the container 9, so that the space 7 is sealed off relative to the environment.

Formed between the length of tubing 2 and the rod 3 is an annular channel 11, which is connected at one end to a connection piece 12 which can be connected to at least one vacuum source, and at the other end opens into a set of radial channels 13 which in the highest position of the sealing sleeve 8 are connected to the top part 14 of the space 7, so that when the connection 12 is open to the vacuum source a vacuum is created in the container 9. When no container 9 is accommodated in a sealing head, the sealing sleeve 8 belonging to it will remain in the lowest position, which means that the connection between the channels 13 and the part 14 is closed through the fact that the bottom inside edge of the slide piece 8' has engaged with the sealing ring 8''.

Formed through the wall of the length of tubing 2 is an axial channel 15, which at its one end opens into a conection piece 15' which can be connected to a source for a pressurized chemically inert gas, for example nitrogen, and at the other end merges into a nozzle 16 which opens into the space 7, in such a way that when the said gas flows through the channel 15, a gas jet is blown into the container 9, being directed in the direction of the arrow A obliquely towards the container 9.

A locking mechanism is provided for retaining cap 6 when the space 7 is connected to the vacuum source. When the successive steps of creating a vacuum inside a container 9 and blowing a gas into the container through a nozzle 16 have been completed, the container 9 is finally closed off by moving the rod 4 downwards, thereby causing the closing cap 6 to be pressed into the filling opening of the container 9, the locking mechanism 17 then being disengaged.

As shown in FIG. 2, the control mechanism of the device comprises an essentially closed housing formed by a sleeve 18 which is mounted by means of rolling bearings so that it is rotatable about the column 1. The housing comprises further a top disc 19 fixed to the sleeve 18 a peripheral wall 20, and inner and outer annular discs 21 and 22, which are separated from each other by a partition wall 23, by means of which the inside of the closed housing is also divided into two annular chambers 24 and 25. The outer annular chamber 25 is connected by means of the connecting piece 26 having the measuring point 27 to a source of a chemically inert compressed gas, for example nitrogen, while the inner annular chamber 24 is connected by means of the connecting piece 28 having the measuring point 29 to a first vacuum source. Passed through the inner annular chamber 24 is a length of tubing 30, which at its top end is connected to the connecting piece 31 with measuring point 32, which is connected to a second vacuum source. At the bottom end the length of tubing 30 is accommodated in an opening in the inner annular disc 21.

At their bottom faces the rings 21 and 22 are provided with rings 21' and 22' made of Teflon or a similar material. However it is also possible to replace rings 21, 21' and 22, 22' respectively by one single ring made of a plastic material (e.g., Deldrin).

Provided in the inner disc 21 are a number of openings 33, 34, 35 (see FIG. 3), which at their bottom ends open into oblong openings 33', 34' and 35', which are provided in the Teflon layer 21'. The bottom end of the length of tubing 30 is accommodated in the opening 35.

Drilled in the outer disc 22 are a number of openings 36, 36', 37, 37', and 38. The openings 36 and 36' open into an oblong opening 36'' which is disposed in the Teflon layer 22', the openings 37 and 37' open into an oblong opening 37'' disposed in the Teflon layer 22', and the opening 38 opens into the oblong opening 38' disposed in the Teflon layer 22'.

A disc 39 is fixed to the column 1 in such a way that the top faces of this disc rest in sealing fashion against the annular Teflon layers 21' and 22'. Disposed in this disc 39 are a number of openings 40 through 49 lying at equal angular distance from each other, and each being connected by means of pipes (not shown) to the connecting piece 15' of a respective sealing head. The disc 39 is provided with a number of openings 50 through 59 lying on an inner circle at equal angular distances from each other, each opening being connected by means of a pipe (not shown) to the connecting piece 12 of a respective sealing head. Thus each pair of openings 40, 50 through 49, 59 belong to one and the same sealing head.

Figure 3:
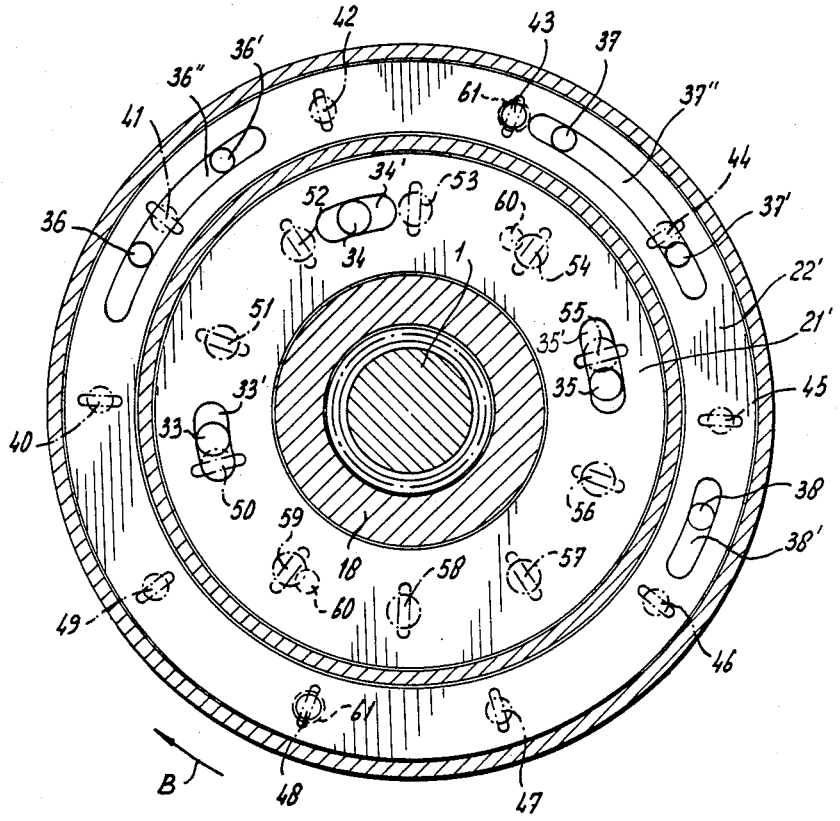
FIG. 3 shows a cross section along the line III—III in FIG. 2.

Whenever now the device is in operation and the column 1—and consequently the disc 39 is rotated in the direction of the arrow B, of for example the pair of openings 40, 50 the opening 50 will first coincide with the opening 33, 33' as a result of which the connection 12 of the particular sealing head and thereby the space 7 thereof is connected to the first vacuum source, so that a vacuum will be created in the container 9. The opening 40 will subsequently coincide with the opening 36'', as shown in FIG. 3 for the opening 41, as a result of which the connection 15' of the sealing based is connected to the source of a compressed gas, so that a gas jet A will be blown out of the nozzle 16 into the container 9. Since the opening 50 has reached the position indicated by 51, the connection to the vacuum source is thereby interrupted. On further rotation of the disc 39, the opening 50 will, however, be brought to coincide with the oblong opening 34', again creating a vacuum in the container 9, while the connection to the source of a compressed gas is broken, due to the fact that the opening 40 will have reached the position indicated by 42. This opening 40 will subsequently coincide with the oblong opening 37'', again causing a gas jet to flow out of the nozzle 16, while the connection with the vacuum source is interrupted again, due to the fact that the relevant opening 50 has reached the position indicated by 54. Since thereafter this opening 50 will reach the position indicated by 55, a connection via the length of tubing 30 between the second vacuum source and the space 7 is formed, thereby creating a final vacuum in the container 9. Immediately after that, the closing cap 6 is pressed into the filling opening of the container by means of the rod 4, following which the container 9 is ready.

Since during the creation of the final vacuum a vacuum is also created in the space 7, it is necessary to release this vacuum in the space 7, to permit the sealing sleeve 8 to be separated from the container to release the container 9. This vacuum is released through the fact that on a further rotation of the disc 39 the opening 40 finally coincides with the oblong opening 38', thereby again connecting the space 7 to the source of a compressed gas.

FIG. 3 also shows the openings 60 and 61, which serve to fix retaining rods for the housing 18, 19, 20, 21, 22.

In the device shown in the figures there are provided ten pairs of openings 40, 50 through 49, 59 in disc 39 so that the said device is designed for having the ten sealing heads, of which one is shown in FIG. 1. However it will be understood that devices according to the invention could have also less or more than ten sealing heads.

I claim:

1. Device for reducing the quantity of oxygen in the space above the filling in a container before closing of the container, in which a vacuum is formed in said space, then a compressed gas which is inert for the contents of the container is blown into the container and again a vacuum is formed in said space, these steps being repeated if necessary, said device comprising: a plurality of sealing heads mounted on a rotatable vertical central column, each of said heads being operationally engageable with the top of a container having a filling opening, so that the filling opening is situated in a space within the sealing head sealed off from the ambient air, means for connecting said space within the sealing head with a vacuum source, valve means operable for alternately putting into communication said space within the sealing head with said vacuum source and a source of a chemically inert gas, and a nozzle in said space within the sealing head connectable with said source of a chemically inert gas, whereby a jet of the said gas flowing out of said nozzle is directed toward the filling opening of a container in a direction extending obliquely to the vertical axis of said container.

2. Device as claimed in claim 1 in which said valve means comprises a fixed, essentially enclosed housing within which are formed, coaxially with the central column, an inner chamber and an outer, essentially annular chamber enclosing the inner chamber, one of said chambers being connectable to said vacuum source and the other chamber to said source of chemically inert gas, each chamber having a head face which is normal to the axis of each chamber being provided with a plurality of openings at specific annular distances from each other and disposed on an inner and an outer circle, respectively, a disc mounted on the central rotating column in sealing fashion against said head faces, two series of openings in said disc with equal angular distances from each other formed on inner and outer circles respectively, the radii of said inner and outer circles in said disc being substantially equal to those of the inner and outer circles defined by said plurality of openings of the head faces and the openings of the inner circles and the openings of the outer circles being individually connected to said space within said sealing head and the nozzle therein respectively.

3. Device according to claim 2, characterized in that a length of tubing extends axially through the chamber connectable to the vacuum source and at the said head face of said chamber connects to one of said plurality of openings provided therein, the other end of said tubing passing through the opposite head face of said chamber and being connectable to a second vacuum source.

4. Device according to claim 3, characterized in that the openings in the said head faces of the chambers, at least the part facing the disc, are in the shape of a circular arc-type groove.

5. Device according to claim 3 characterized in that the sealing heads are each provided with a suction head connectable to a vacuum source for taking into the said space within the sealing head a closing cap or cover for the container, and a catch mechanism in each sealing head to retain the closing cap.

* * * * *